US007362301B2

(12) United States Patent
Sagawa

(10) Patent No.: US 7,362,301 B2
(45) Date of Patent: Apr. 22, 2008

(54) LIQUID CRYSTAL DISPLAY DEVICE AND LIQUID CRYSTAL PANEL

(75) Inventor: Takahiro Sagawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 591 days.

(21) Appl. No.: 10/949,353

(22) Filed: Sep. 27, 2004

(65) Prior Publication Data

US 2005/0099374 A1 May 12, 2005

(30) Foreign Application Priority Data

Oct. 1, 2003 (JP) ..... 2003-342821

(51) Int. Cl.
*G09G 3/36* (2006.01)

(52) U.S. Cl. ..... 345/98; 345/99; 345/100; 345/103

(58) Field of Classification Search ..... 345/132, 345/87, 89, 98, 100, 204, 212, 213, 88, 94, 345/99, 92, 93, 95, 660, 441, 103; 349/149; 315/169.1

See application file for complete search history.

(56) References Cited

U.S. PATENT DOCUMENTS

| | | | | |
|---|---|---|---|---|
| 5,682,177 | A * | 10/1997 | Kuwata et al. | 345/100 |
| 5,801,674 | A * | 9/1998 | Shimizu | 345/103 |
| 5,831,586 | A * | 11/1998 | Hirai et al. | 345/94 |
| 5,926,174 | A * | 7/1999 | Shibamiya et al. | 345/213 |
| 6,215,467 | B1 * | 4/2001 | Suga et al. | 345/660 |
| 6,320,574 | B1 * | 11/2001 | Eglit | 345/213 |
| 6,549,277 | B1 * | 4/2003 | Narushima et al. | 356/218 |
| 6,597,219 | B1 | 7/2003 | Trivedi et al. | |
| 6,809,480 | B2 * | 10/2004 | Shino | 315/169.1 |
| 6,831,622 | B2 | 12/2004 | Aoki | |
| 6,844,866 | B2 * | 1/2005 | Watanabe | 345/88 |
| 6,903,716 | B2 * | 6/2005 | Kawabe et al. | 345/99 |
| 6,980,189 | B2 * | 12/2005 | Maruoka et al. | 345/94 |
| 7,142,187 | B1 * | 11/2006 | Kim et al. | 345/100 |
| 2001/0026252 | A1 * | 10/2001 | Shibata et al. | 345/60 |
| 2002/0093474 | A1 * | 7/2002 | Toyoshima et al. | 345/87 |
| 2002/0186192 | A1 * | 12/2002 | Maruoka et al. | 345/87 |
| 2003/0151713 | A1 * | 8/2003 | Aoki | 349/149 |
| 2003/0169247 | A1 * | 9/2003 | Kawabe et al. | 345/204 |
| 2004/0004595 | A1 * | 1/2004 | Isami et al. | 345/89 |
| 2005/0219188 | A1 * | 10/2005 | Kawabe et al. | 345/94 |

FOREIGN PATENT DOCUMENTS

| | | |
|---|---|---|
| CN | 1191563 C | 3/2005 |
| JP | A 11-282426 | 10/1999 |
| JP | A 2000-171774 | 6/2000 |
| JP | A 2000-267632 | 9/2000 |
| JP | A 2001-324970 | 11/2001 |
| KR | 2001-0004878 A | 1/2001 |

* cited by examiner

*Primary Examiner*—Prabodh Dharia
(74) *Attorney, Agent, or Firm*—Oliff & Berridge, PLC

(57) ABSTRACT

A liquid crystal display device has a liquid crystal panel module, sampling circuits that sample video signals a timing adjustment module driving signal generators and a dummy element. The timing adjustment module detects a variation in signal delay in the driving signal generators with a temperature change or with time, as a phase difference of an output signal from the dummy element relative to a reference signal. The timing adjustment module adjusts the phase of the timing signal corresponding to the detected phase difference. This arrangement corrects a temporal deviation of the sampling circuit driving signals from the video signals, which is caused by the variation in signal delay in the driving signal generators, and thereby effectively restrains the occurrence of ghost.

6 Claims, 10 Drawing Sheets

200
N
N+1
N+2
N+3
N+4
N+5
N+6
N+7
N+8
N+9
N+10
N+11
Black
Light Gray
201
VID 1~6
Light Gray (3V)
Ta
Tb
Black (2V)
(Adequate State)
Pa (N~N+5)
Pb (N+6~N+11)
Sk
Sk+1

Dark Gray A
Dark Gray B

Dark Gray C
Dark Gray D
(Advance State)
(Lag State)

LIQUID CRYSTAL DISPLAY DEVICE AND LIQUID CRYSTAL PANEL

BACKGROUND OF THE INVENTION

1. Field of the Invention

The present invention relates to a liquid crystal display device equipped with a liquid crystal panel. More specifically the invention pertains to a technique of restraining the appearance of ghost in a displayed image, due to a variation in signal delay in the liquid crystal panel with a temperature change or with time.

2. Description of the Related Art

In a liquid crystal display device equipped with an active matrix-driving liquid crystal panel driven by thin film transistors (hereafter referred to as TFTs), a large number of scanning lines and data lines respectively arranged in rows and columns and a large number of pixel electrodes set at respective intersections of the scanning lines and the data lines are formed on a glass substrate. Periphery circuits including a scanning line driving circuit, a data line driving circuit, sampling circuits, and pixel TFT circuits may also be formed on the glass substrate. Liquid crystal cells corresponding to the large number of pixel electrodes are sealed between a pair of facing glass substrates to form a liquid crystal panel.

The data line driving circuit generates a sampling circuit driving signal to determine a drive timing of each sampling circuit, in response to a timing signal output from a timing generator, and outputs the generated sampling circuit driving signal to the sampling circuit.

The sampling circuit includes a switching element like a TFT and outputs an externally-given video signal to the pixel TFT circuit during only a high-level time period of the sampling circuit driving signal.

The pixel TFT circuit receives a scanning signal output from the scanning line driving circuit and outputs the video signal to the pixel electrodes during only a high-level time period of the scanning signal.

In response to input of the video signal, a voltage between each pixel electrode and a common electrode varies to change the configuration of liquid crystal molecules in the liquid crystal cell sealed between the pixel electrode and the common electrode. The light entering the liquid crystal cells is permitted to transmit or is blocked off in response to the video signal, and is modulated to display a resulting image corresponding to the video signal across the liquid crystal panel.

When the high-level time period of the sampling circuit driving signal is temporally consistent with a saturation time period of the externally input video signal in the sampling circuit, an adequate image is displayed according to the video signal. The high-level time period of the sampling circuit driving signal may, however, be temporally deviated by a manufacturing variation in internal delay of each liquid crystal panel or by a variation in internal delay of the liquid crystal panel with a temperature change or with time in use. This may lead to the appearance of ghost in a resulting displayed image.

The relation between the temporal deviation of the high-level time period of the sampling circuit driving signals and the occurrence of ghost is described with reference to FIG. 2.

FIGS. 2(A) to 2(C) show temporal relations between a video signal VID externally input into sampling circuits and sampling circuit driving signals S input from the data line driving circuit into the sampling circuits, as well as images displayed on a liquid crystal panel 200 in the respective temporal relations.

The video signal VID represents a substantially rectangular window pattern 201 on light gray background and is expanded to 6 phases VID1 to VID6. The video signals VID1 to VID6 are simultaneously input into 6 consecutive pixel electrodes via 6 consecutive sampling circuits and pixel TFT circuits.

A different sampling circuit driving signal S1, S2, . . . is generated for each group of 6 consecutive sampling circuits. For explanation of the appearance of ghost with regard to 12 consecutive pixels N to N+11, FIG. 2 shows only two sampling circuit driving signals, that is, a sampling circuit driving signal Sk corresponding to pixels N to N+5 and a sampling circuit driving signal Sk+1 corresponding to pixels N+6 to N+11.

The video signals VID1 to VID6 are expressed by a waveform having a voltage level (2 V) representing black and a voltage level (3 V) representing light gray. The waveform is dulled by integration in an internal circuit. It is thus important to output the video signals VID1 to VID6 to the pixel TFT circuits during saturation time periods when the video signals VID1 to VID6 have reached saturation levels (for example, at latest time periods in respective video signal cycles Ta and Tb in the example of FIG. 2).

FIG. 2(A) shows an adequate state where the sampling circuit driving signals Sk and Sk+1 have an adequate temporal relation to the video signals VID1 to VID6. FIG. 2(B) shows a temporal advance state where the sampling circuit driving signals Sk and Sk+1 are advanced relative to the video signals VID1 to VID6 from the state of FIG. 2(A). FIG. 2(C) shows a temporal lag state where the sampling circuit driving signals Sk and Sk+1 are delayed relative to the video signals VID1 to VID6 from the state of FIG. 2(A).

In the example of FIG. 2, a high-level time period Pa of the sampling circuit driving signal Sk specifies an input timing of the video signals VID1 to VID6 to the pixel TFT circuits corresponding to the 6 consecutive pixels N to N+5, which are extended outward from a left end of the window pattern 201.

In the state of FIG. 2(A), the high-level time period Pa is temporally consistent with a saturation time period in the video signal cycle Ta when the video signals VID1 to VID6 have reached a saturation level (3 V) of light gray. The video signals VID1 to VID6 representing light gray are thus input respectively to the pixel electrodes corresponding to the pixels N to N+5.

A high-level time period Pb of the sampling circuit driving signal Sk+1 specifies an input timing of the video signals VID1 to VID6 to the pixel TFT circuits corresponding to the 6 consecutive pixels N+6 to N+11, which are extended inward from the left end of the window pattern 201.

In the state of FIG. 2(A), the high-level time period Pb is temporally consistent with a saturation time period in the video signal cycle Tb when the video signals VID1 to VID6 have reached a saturation level (2 V) of black. The video signals VID1 to VID6 representing black are thus input respectively to the pixel electrodes corresponding to the pixels N+6 to N+11.

In the state of FIG. 2(A), no ghost appears on the left end of the window pattern 201.

A similar phenomenon arises on the right end of the window pattern 201. A high-level time period of a sampling circuit driving signal S corresponding to 6 consecutive pixels, which are extended inward from a right end of the window pattern 201, is temporally consistent with a saturation time period in a video signal cycle when the video signals VID1 to VID6 have reached the saturation level (2 V) of black. A high-level time period of a sampling circuit driving signal S corresponding to 6 consecutive pixels, which are extended outward from the right end of the window pattern 201, is temporally consistent with a saturation time period in a video signal cycle when the video signals VID1 to VID6 have reached the saturation level (3 V) of light gray. There is accordingly no ghost appearing on the right end of the window pattern 201.

This phenomenon is not restricted to the lines of the pixels N to N+11 but appears on all the lines of the liquid crystal panel. No ghost accordingly appears in the whole image as shown in FIG. 2W).

In the state of FIG. 2(B), the sampling circuit driving signals Sk and Sk+1 are temporally advanced to advance the high-level time period Pa and the high-level time period Pb. Especially part of the high-level time period Pb is deviated from the saturation time period in the video signal cycle Tb when the video signals VID1 to VID6 have reached the saturation level (3 V) of black and temporally overlaps with a voltage level close to light gray. The video signals VID1 to VID6 having the voltage level close to light gray, as well as the video signals VID1 to VID6 at the saturation level (2 V) of black are thus input into the pixel electrodes corresponding to the pixels N+6 to N+11. Such mixture leads to the occurrence of a dark gray ghost A inside the left end of the window pattern 201.

A similar phenomenon arises on 6 consecutive pixels, which are extended outward from the right end of the window pattern 201. The video signals VID1 to VID6 having a voltage level close to black, as well as the video signals VID1 to VID6 at the saturation level (3 V) of light gray are input into the respective pixel electrodes. Such mixture leads to the occurrence of a dark gray ghost B outside the right end of the window pattern 201.

This phenomenon is not restricted to the lines of the pixels N to N+11 but appears on all the lines of the liquid crystal panel. The dark gray ghost A accordingly appears inside the whole left end of the window pattern 201, while the dark gray ghost B appears outside the whole right end of the window pattern 201, as shown in FIG. 2(B).

The depths of the dark gray ghosts A and B depend upon the degrees of the temporal advances of the sampling circuit driving signals Sk and Sk+1.

In the state of FIG. 2(C), the sampling circuit driving signals Sk and Sk+1 are temporally delayed to delay the high-level time period Pa and the high-level time period Pb. Especially part of the high-level time period Pa is deviated from the saturation time period in the video signal cycle Ta when the video signals VID1 to VID6 have reached the saturation level (3 V) of light gray and temporally overlaps with a voltage level close to black. The video signals VID1 to VID6 having the voltage level close to black, as well as the video signals VID1 to VID6 at the saturation level (3 V) of light gray are thus input into the pixel electrodes corresponding to the pixels N to N+5. Such mixture leads to the occurrence of a dark gray ghost C outside the left end of the window pattern 201.

A similar phenomenon arises on 6 consecutive pixels, which are extended inward from the right end of the window pattern 201. The video signals VID1 to VID6 having a voltage level close to light gray, as well as the video signals VID1 to VID6 at the saturation level (2 V) of black are input into the respective pixel electrodes. Such mixture leads to the occurrence of a dark gray ghost D inside the right end of the window pattern 201.

This phenomenon is not restricted to the lines of the pixels N to N+11 but appears on all the lines of the liquid crystal panel. The dark gray ghost C accordingly appears outside the whole left end of the window pattern 201, while the dark gray ghost D appears inside the whole right end of the window pattern 201, as shown in FIG. 2(C).

The depths of the dark gray ghosts C and D depend upon the degrees of the temporal lags of the sampling circuit driving signals Sk and Sk+1.

The above description regards the liquid crystal panel of monochromatic display. The similar phenomenon also appears in liquid crystal panels of color display, for example, a liquid crystal panel that colors the transmitted light with one of color filters R (red), G (green), and B (blue) with regard to each pixel. In this color display technique, 3 consecutive pixels compose one color and thus correspond to one pixel in the liquid crystal panel of monochromatic display.

The liquid crystal display device having the circuit structure discussed above has been proposed, for example, in Japanese Patent Laid-Open Gazette No. 11-282426.

The prior art technique adjusts the temporal deviation of the sampling circuit driving signals from the video signals, which may lead to the appearance of ghost, with regard to each liquid crystal panel in its manufacturing process.

One concrete procedure displays a ghost test pattern including the black window pattern 201 on the light gray background as shown in FIG. 2 on the liquid crystal panel and measures a difference in luminance between the background color and the appearing ghost. The procedure detects a timing of the minimum luminance difference and stores the detected timing in a memory. The liquid crystal display device is then reset to read the timing from the memory and reflects the timing on the setting of a timing setting register built in the timing generator. This gives an adequate timing of the timing signal and adjusts the temporal deviation of the sampling circuit driving signals, which are generated in response to the timing signal, from the video signals.

Even when such adjustment is carried out, however, there is a signal delay in the liquid crystal panel with a temperature change or with time in use of the liquid crystal panel. The variation in signal delay temporally deviates the sampling circuit driving signals from the video signals and may lead to the appearance of ghost in a resulting displayed image.

SUMMARY OF THE INVENTION

The object of the invention is thus to correct a temporal deviation of sampling circuit driving signals from video signals, which is caused by a variation in signal delay in a liquid crystal panel with a temperature change or with time, in a liquid crystal display device and thereby restrain the occurrence of ghost.

In order to attain at least part of the above and the other related objects, the invention is directed to a first liquid crystal display device, which has a liquid crystal panel module and a timing supply module that supplies a timing signal to the liquid crystal panel module.

The liquid crystal panel module includes: multiple liquid crystal cells that are arranged in a matrix; multiple pixel electrodes that are provided corresponding to the respective liquid crystal cells; multiple data lines that input a video signal to the respective pixel electrodes; multiple sampling circuits that are provided corresponding to the respective data lines to sample the video signal in response to a sampling circuit driving signal and output the sampled video signal to the respective data lines; and a driving signal generator that generates the sampling circuit driving signal in response to the timing signal. The timing supply module includes: a timing generator that generates the timing signal; and a timing adjuster that adjusts a phase of the generated timing signal.

The liquid crystal panel module has a dummy element, which is formed at least with the driving signal generator on an identical substrate and receives input of the timing signal. The timing adjuster adjusts the phase of the generated timing signal, in order to enable an output signal from the dummy element to keep a specific phase relation to a separately provided reference signal.

In the first liquid crystal display device of the invention, the timing generator generates the timing signal, and the timing adjuster adjusts the phase of the generated timing signal. The driving signal generator generates the sampling circuit driving signal in response to the timing signal. The dummy element inputs the timing signal. The dummy element is formed with at least the driving signal generator on an identical substrate and accordingly has similar levels of parasitic capacitance and wiring resistance and equivalent retardance to those of the driving signal generator.

On condition that the sampling circuit driving signal has the adequate timing relative to the video signal and that no ghost appears in a resulting displayed image, the output signal from the dummy element has the specific phase relation to the reference signal.

A variation in signal delay in the driving signal generator with a temperature change or with time advances or delays the sampling circuit driving signal relative to the video signal and accordingly causes a timing deviation of the sampling circuit driving signal from the video signal. This leads to the appearance of ghost in a resulting displayed image. Similarly there is a variation in signal delay in the dummy element. This variation advances or delays the output signal from the dummy element relative to the reference signal. The output signal from the dummy element can thus not keep the specific phase relation to the reference signal.

The timing adjuster delays or advances the phase of the timing signal, in order to enable the output signal from the dummy element to keep the specific phase relation to the reference signal. This restores the advanced or delayed sampling circuit driving signal relative to the video signal to the original state and cancels out the timing deviation of the sampling circuit driving signal from the video signal, thus effectively restraining the occurrence of ghost in a resulting displayed image.

In one preferable embodiment of the first liquid crystal display device of the invention, the timing adjuster includes: a phase comparator that compares a phase of the reference signal with a phase of the output signal from the dummy element and outputs a phase difference signal corresponding to a result of the comparison; a charge pump that outputs a control voltage and regulates a level of the control voltage in response to the phase difference signal output from the phase comparator; and a delay element that varies a delay of the timing signal and thereby adjusts the phase of the timing signal according to the regulated level of the control voltage.

In the first liquid crystal display device of this structure, in the event of an advance or a delay of the output signal from the dummy element relative to the reference signal, the phase comparator compares the phase of the output signal from the dummy element with the phase of the reference signal, and outputs the phase difference signal corresponding to the result of the comparison. The charge pump receives the phase difference signal and regulates the level of the control voltage, which is to be output to the delay element, in response to the phase difference signal. The delay element increases or decreases the delay of the timing signal according to the regulated level of the input control voltage to delay or advance the phase of the timing signal. This restores the advanced or delayed output signal from the dummy element relative to the reference signal to the original state and enables the output signal from the dummy element to keep the specific phase relation to the reference signal.

In another preferable embodiment of the first liquid crystal display device of the invention, the timing adjuster includes: a phase comparator that compares a phase of the reference signal with a phase of the output signal from the dummy element and outputs a phase difference signal corresponding to a result of the comparison; an oscillator that outputs a clock signal and regulates a frequency of the clock signal in response to the phase difference signal output from the phase comparator; and a delay element that varies a delay of the timing signal and thereby adjusts the phase of the timing signal according to the regulated frequency of the clock signal.

In the first liquid crystal display device of this structure, in the event of an advance or a delay of the output signal from the dummy element relative to the reference signal, the phase comparator compares the phase of the output signal from the dummy element with the phase of the reference signal, and outputs the phase difference signal corresponding to the result of the comparison. The oscillator receives the phase difference signal and regulates the frequency of the clock signal to be output to the delay element, in response to the input phase difference signal. The delay element increases or decreases the delay of the timing signal according to the regulated frequency of the input clock signal to delay or advance the phase of the timing signal. This restores the advanced or delayed output signal from the dummy element relative to the reference signal to the original state and enables the output signal from the dummy element to keep the specific phase relation to the reference signal.

The present invention is also directed to a second liquid crystal display device, which includes a liquid crystal panel module, a video signal supply module that supplies a video signal to the liquid crystal panel module, a timing supply module that supplies a timing signal to the liquid crystal panel module, and a video signal control module that controls the video signal supply module.

The liquid crystal panel module has: multiple liquid crystal cells that are arranged in a matrix; multiple pixel electrodes that are provided corresponding to the respective liquid crystal cells; multiple data lines that input the video signal to the respective pixel electrodes; multiple sampling circuits that are provided corresponding to the respective data lines to sample the video signal in response to a sampling circuit driving signal and output the sampled video signal to the respective data lines; and a driving signal generator that generates the sampling circuit driving signal in response to the timing signal.

The liquid crystal panel module has a dummy element, which is formed at least with the driving signal generator on an identical substrate and receives input of the timing signal. The video signal control module controls the video signal supply module to adjust a phase of the video signal, in order to enable an output signal from the dummy element to keep a specific phase relation to a separately provided reference signal.

In the second liquid crystal display device of the invention, in the event of a variation in signal delay in the driving signal generator with a temperature change or with time to advance or lag the sampling circuit driving signal from the video signal, the video signal control module controls the video signal supply module to advance or delay the phase of the video signal, in order to enable the output signal from the dummy element to keep the specific phase relation to the reference signal. This arrangement enables the video signal to catch up with or to be caught by the advanced or delayed sampling circuit driving signal and cancels out a timing deviation of the sampling circuit driving signal from the video signal, thus effectively restraining the appearance of ghost in a displayed image.

In one preferable embodiment of the second liquid crystal display device of the invention, the video signal supply module has a D/A conversion circuit that converts a digital video signal into an analog video signal, in response to a separately supplied clock signal. The video signal control module has a timing adjuster that adjusts a phase of the clock signal supplied to the D/A conversion circuit. The timing adjuster adjusts the phase of the clock signal, in order to enable the output signal from the dummy element to keep the specific phase relation to the reference signal.

The phase of the clock signal supplied to the D/A conversion circuit is adjusted in the process of converting the digital video signal into an analog video signal. Such adjustment advances or delays the phase of the video signal.

The invention is further directed to a liquid crystal panel that receives at least inputs of a timing signal and a video signal. The liquid crystal panel includes: multiple liquid crystal cells that are arranged in a matrix; multiple pixel electrodes that are provided corresponding to the respective liquid crystal cells; multiple data lines that input the video signal to the respective pixel electrodes; multiple sampling circuits that are provided corresponding to the respective data lines to sample the video signal in response to a sampling circuit driving signal and output the sampled video signal to the respective data lines; a driving signal generator that generates the sampling circuit driving signal in response to the timing signal; a dummy element that is formed at least with the driving signal generator on an identical substrate and receives input of the timing signal; a terminal that inputs the timing signal to the dummy element; and a terminal that supplies an output signal from the dummy element to outside.

The liquid crystal panel of this structure readily attains the functions of the liquid crystal display device of the invention discussed above.

These and other objects, features, aspects, and advantages of the present invention will become more apparent from the following detailed description of the preferred embodiment with the accompanied drawings.

DESCRIPTION OF THE PREFERRED EMBODIMENTS

One mode of carrying out the invention is discussed below as a preferred embodiment in the following sequence:

A. Embodiment

A1. Structure of Liquid Crystal Display Device
A2. Specific Operations in Adequate State
A3. Specific Operations in Advance State
A4. Specific Operations in Lag State
A5. Another Example of X Timing Auto Adjustment Circuit B. Modifications

A. Embodiment

A1. Structure of Liquid Crystal Display Device

The general structure of a liquid crystal display device in one embodiment of the invention is described below with reference to FIG. 3.

Figure 3:
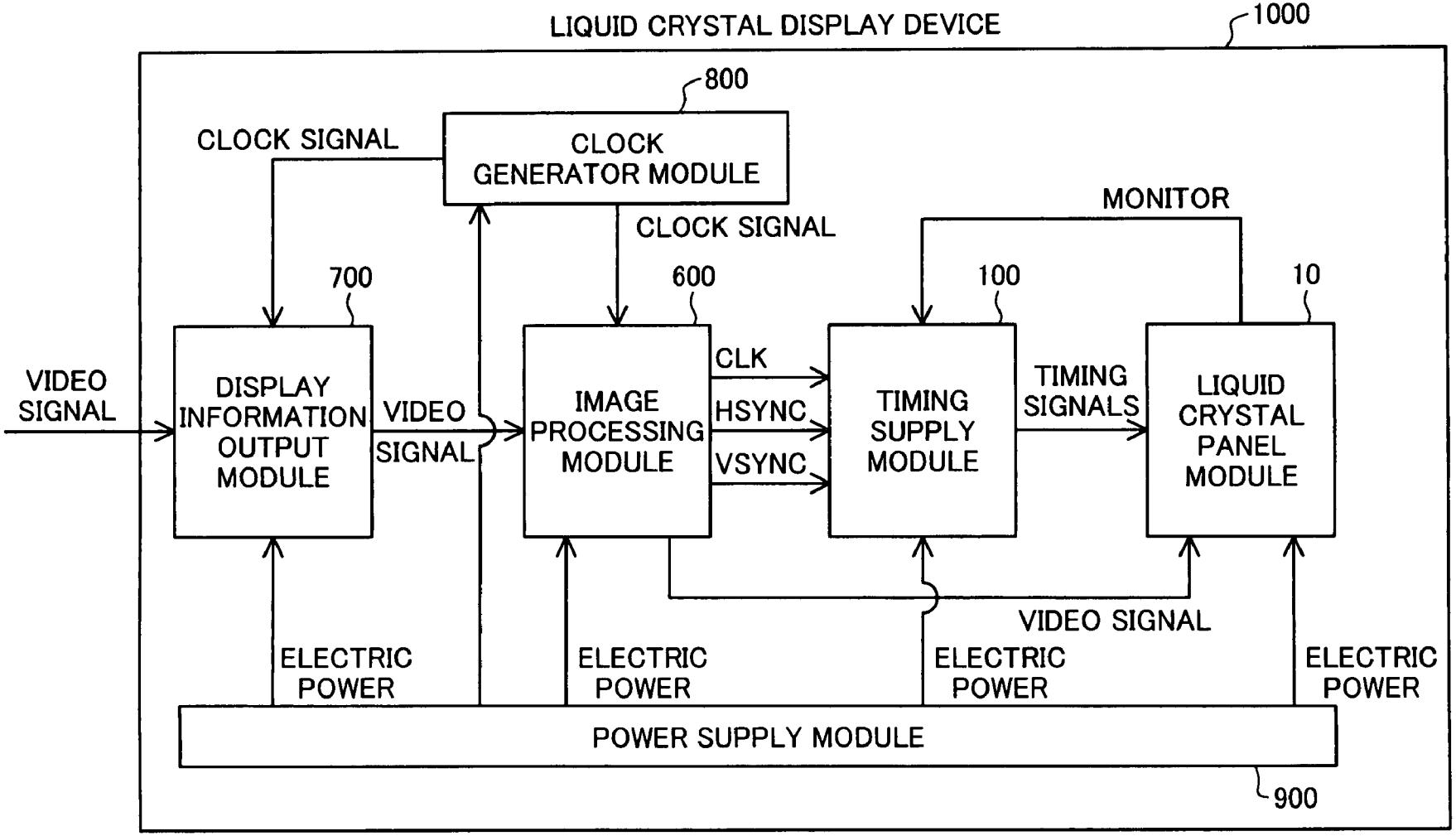
FIG. 3 schematically illustrates the structure of a liquid crystal display device 1000 in the embodiment of the invention.

FIG. 3 schematically illustrates the structure of a liquid crystal display device 1000 in the embodiment of the invention. As shown in FIG. 3, the liquid crystal display device 1000 includes a liquid crystal panel module 10, a timing supply module 100, an image processing module 600, a display information output module 700, a clock generator module 800, and a power supply module 900.

The display information output module 700 receives an externally input video signal, converts the input video signal into a preset format of video signal in response to a clock signal from the clock generator module 800, and outputs the preset format of video signal to the image processing module 600. The image processing module 600 makes the input video signal subjected to diverse series of image processing and outputs the processed video signal to the liquid crystal panel module 10, while outputting a clock signal CLK, a horizontal synchronizing signal HSYNC, and a vertical synchronizing signal VSYNC to the timing supply module 100. The timing supply module 100 generates timing signals of defining drive timings of the liquid crystal panel module 10, in response to the clock signal CLK, the horizontal synchronizing signal HSYNC, and the vertical synchronizing signal VSYNC input from the image processing module 600, and outputs the timing signals to the liquid crystal panel module 10. The liquid crystal panel module 10 is driven by the timing signals input from the timing supply module 100 to display the video signal input from the image processing module 600 in the form of an image, simultaneously with output of a monitor signal MONITOR to the timing supply module 100. The power supply module 900 supplies electric power to the respective modules of the liquid crystal display device 1000.

Figure 1:
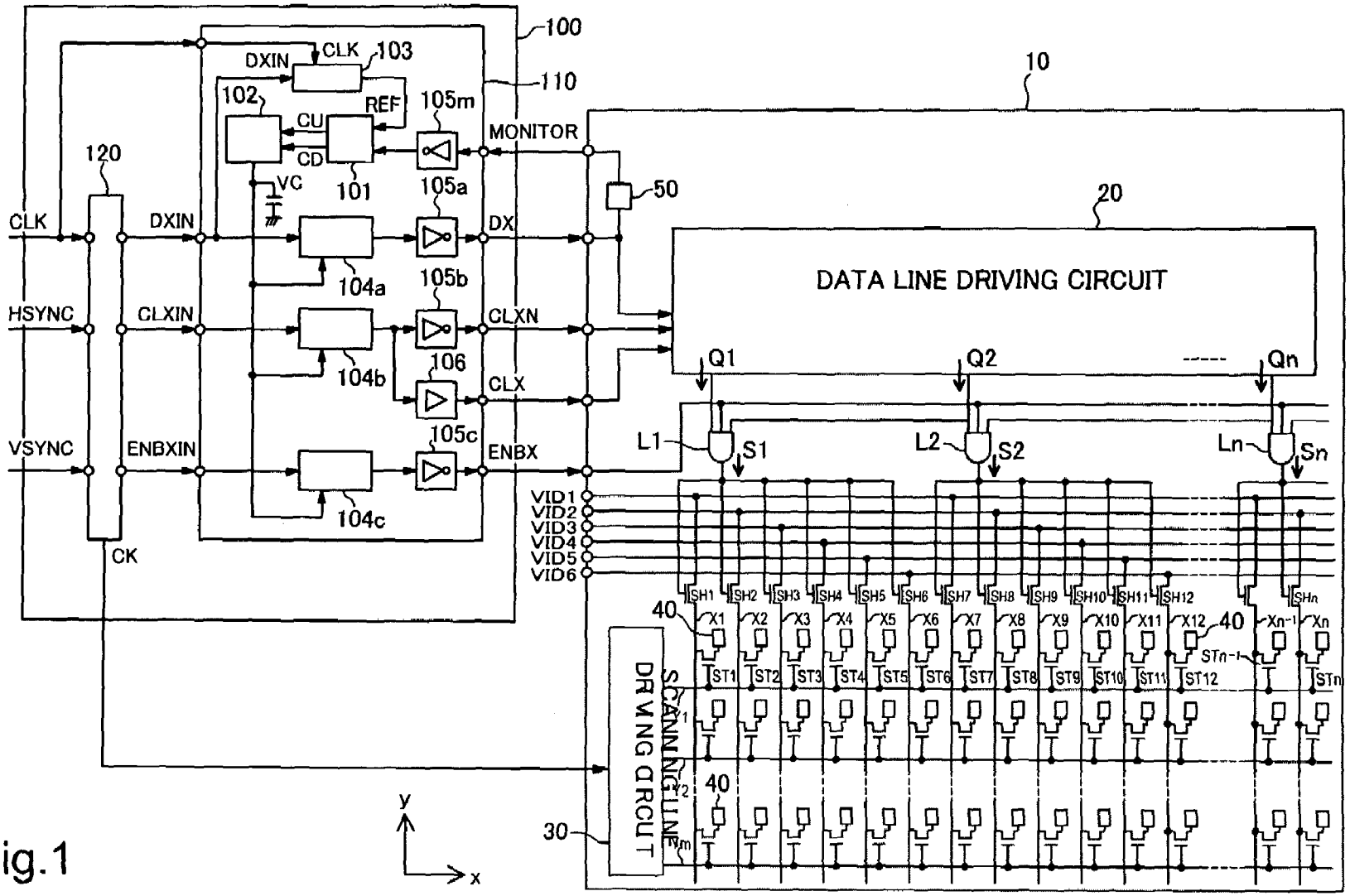
FIG. 1 schematically illustrates the structure of a timing supply module 100 and a liquid crystal panel module 10 in one embodiment of the invention.

The following describes the general structure of the liquid crystal panel module 10 and the timing supply module 100 in the liquid crystal display device 1000 with reference to FIG. 1.

FIG. 1 schematically illustrates the structure of the timing supply module 100 and the liquid crystal panel module 10 in the embodiment of the invention. As shown in FIG. 1, the timing supply module 100 includes a timing generator 120 and an X timing auto adjustment circuit 110, which is characteristic of the invention.

The liquid crystal panel module 10 includes a data line driving circuit 20, a scanning line driving circuit 30, pixel electrodes 40, scanning lines Y1 to Ym, data lines X1 to Xn, sampling circuits SH1 to SHn, pixel TFT circuits ST1 to STn, 3-input AND circuits L1 to Ln, and a dummy element 50, which is characteristic of the invention.

The timing generator 120 receives the clock signal CLK, the horizontal synchronizing signal HSYNC, and the vertical synchronizing signal VSYNC output from the image processing module 600 shown in FIG. 3, generates a start signal DXIN, a clock signal CLXIN, and an enable signal ENBXIN as timing signals, and outputs the timing signals DXIN, CLXIN, and ENBXIN to the X timing auto adjustment circuit 110 as shown in FIG. 1.

The X timing auto adjustment circuit 110 has variable delay elements 104*a* to 104*c* that add delays to the input timing signals and vary the amounts of delays in response to a separately supplied control voltage VC, level shifters 105*a* to 105*c* and another level shifter 106 that shift the levels of the delayed timing signals output from the variable delay elements 104*a* through 104*c*, and a stationary delay element 103 that adds a delay to the start signal DXIN in response to the separately input clock signal CLK and generates and outputs a reference signal REF.

The X timing auto adjustment circuit 110 also has a level shifter 105*m* that receives the monitor signal MONITOR output from the liquid crystal panel module 10, shifts the level of the input monitor signal MONITOR, and outputs the level-shifted monitor signal MONITOR, a phase comparator 101 that receives the level-shifted monitor signal MONITOR output from the level-shifter 105*m* and the reference signal REF, compares the phases of these two input signals, and in the presence of a phase difference of not equal to 0, selectively outputs either of a charge-up pulse CU and a charge-down pulse CD corresponding to the phase difference, and a charge pump 102 that supplies the control voltage VC to the variable delay elements 104*a* to 104*c* and varies the level of the control voltage VC in response to the input charge-up pulse CU or charge-down pulse CD.

The liquid crystal panel module 10 has the multiple pixel electrodes 40 that are arranged in a matrix in 'x' and 'y' directions, the multiple data lines X1 to Xn that are arranged in the 'x' direction and are extended in the 'y' direction, the multiple scanning lines Y1 to Ym that are arranged in the 'y' direction and are extended in the 'x' direction, and the multiple pixel TFT circuits ST1 to STn that are constructed as switching elements of TFTs and are provided corresponding to the respective pixel electrodes 40. The data lines X1 to Xn, the pixel electrodes 40, and the scanning lines Y1 to Ym are respectively connected to source electrodes, drain electrodes, and gate electrodes of the pixel TFT circuits ST1 to STn to control connection to and disconnection from the corresponding pixel electrodes 40, as shown in FIG. 1.

In the liquid crystal panel module 10, the scanning line driving circuit 30 successively selects the scanning lines Y1 to Ym at preset timings in response to a clock signal CK supplied from the timing generator 120 and outputs scanning signals to the selected scanning lines Y1 to Ym. The data line driving circuit 20 generates output signals Q1 to Qn, in response to three timing signals, a clock signal CLX, an inverted clock signal CLXN, and a start signal DX, output from the X timing auto adjustment circuit 110. Both the scanning line driving circuit 30 and the data line driving circuit 20 include shift registers and other circuit elements.

The liquid crystal panel module 10 also has the multiple 3-input AND circuits L1 to Ln that receive signals including the output signals Q1 to Qn from the data line driving circuit 20 and output sampling circuit driving signals S1 to Sn, and the multiple sampling circuits SH1 to SHn that are constructed as switching elements of TFTs and are provided corresponding to the respective data lines X1 to Xn.

The sampling circuits SH1 to SHn receive video signals VID1 to VID6, which are output from the image processing module 600 shown in FIG. 3 and are expanded in parallel to 6 phases, sample the input video signals VID1 to VID6 in response to the sampling circuit driving signals S1 to Sn output from the 3-input AND circuits L1 to Ln, and output the sampled video signals VID1 to VID6 to the corresponding data lines X1 to Xn.

The sampling circuit driving signal output from one 3-input AND circuit is input in parallel to 6 consecutive sampling circuits SH1 to SH6. The video signals VID1 to VID6 are expanded in parallel to 6 phases as mentioned above, and are thus output to the 6 consecutive sampling circuits SH1 to SH6 at an identical timing for an identical time period.

The liquid crystal panel module 10 also has the dummy element 50, which is characteristic of the invention. The dummy element 50 receives input of the start signal DX, which is output from the X timing auto adjustment circuit 110 and is also input into the data line driving circuit 20. The dummy element 50 outputs the monitor signal MONITOR to the level shifter 105*m* included in the X timing auto adjustment circuit 110.

The dummy element 50 is formed, together with the data line driving circuit 20 and the 3-input AND circuits L1 to Ln of the liquid crystal panel module 10, on an identical glass substrate by the same manufacturing process. The dummy element 50 accordingly has similar levels of parasitic capacitance and wiring resistance and equivalent retardance to those of the data line driving circuit 20 and the 3-input AND circuits L1 to Ln. In use of the liquid crystal panel module 10, when the data line driving circuit 20 or the 3-input AND circuits L1 to Ln have a variation in signal delay with a temperature change or with time, it is assumed that the dummy element 50 has an equivalent variation in signal delay.

The description now regards the specific operations of the liquid crystal display device 1000 to prevent the appearance of ghost in the embodiment.

For the simplicity of explanation, it is assumed that each of the video signals VID1 to VID6 is a monochromatic video signal common to the respective panels and is expressed by a waveform having a relatively low voltage level representing black and a relatively high voltage level representing light gray. These operations are similarly applicable to different color video signals given to the respective panels.

A2. Specific Operations in Adequate State

Figures 2A, 2B, 2C:
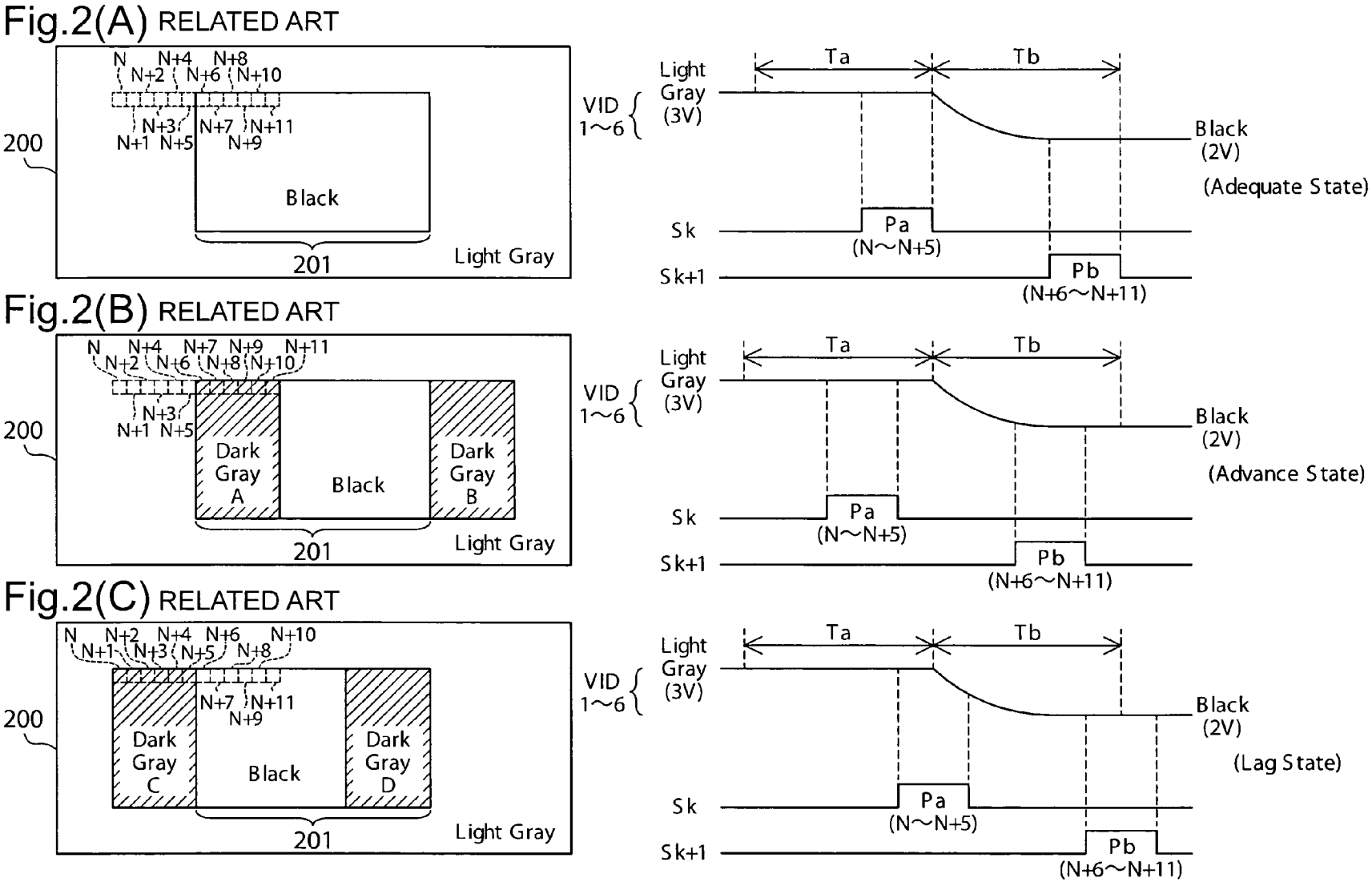
Fig.2(A) RELATED ART
Fig.2(B) RELATED ART
Fig.2(C) RELATED ART
FIGS. 2(A), 2(B), and 2(C) show temporal relations of video signals VID1 to VID6 and sampling circuit driving signals Sk and Sk+1, as well as images displayed on a liquid crystal panel 200 in the respective temporal relations.
Figure 4:
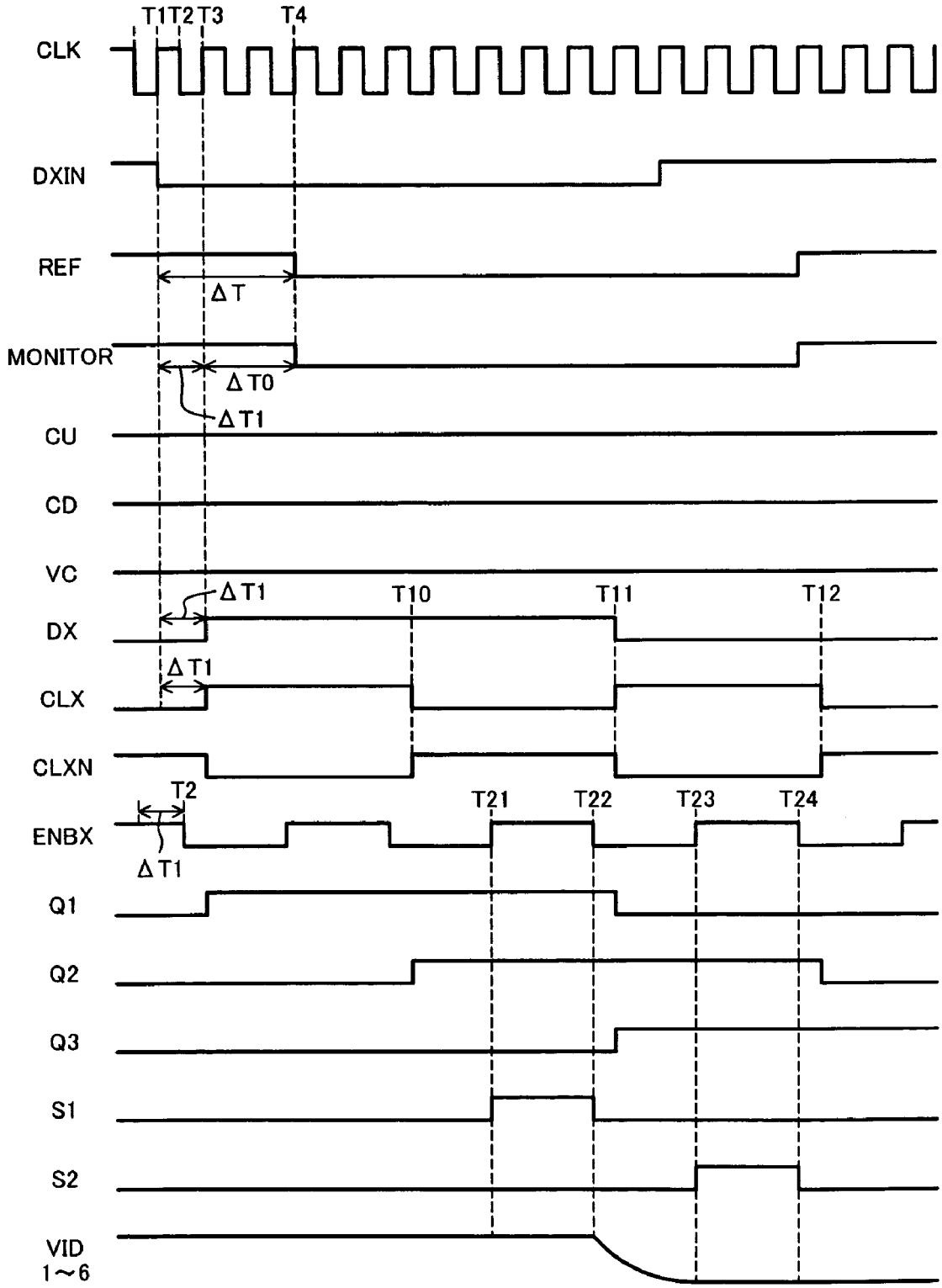
FIG. 4 is a timing chart showing the timings of respective signals in an adequate state in the embodiment.

As shown in FIG. 2(A), the description first regards the specific operations in an adequate state without the occurrence of ghost, where high-level time periods of the sampling circuit driving signals S1 to Sn are temporally consistent with saturation time periods of the video signals VID1 to VID6. FIG. 4 is a timing chart showing the timings of the respective signals in this adequate state.

Among the timing signals generated by the timing generator 120, that is, the start signal DXIN, the clock signal CLXIN, and the enable signal ENBXIN, the start signal DXIN is delayed by a preset delay ΔT1 by the variable delay element 104*a*, goes through a level shift by the level shifter 105*a*, and is input as the start signal DX to the data line driving circuit 20. The start signal DXIN accordingly falls to a low level at a timing T1 in the timing chart of FIG. 4, whereas the start signal DX rises to a high level at a timing T3 after the preset delay ΔT1.

Like the start signal DXIN, the enable signal ENBXIN is delayed by the same delay ΔT1 by the variable delay element 104*c*, goes through a level shift by the level shifter 105*c*, and is input as an enable signal ENBX to the liquid crystal panel module 10. The enable signal ENBX accordingly falls to the low level at a timing T2 in the timing chart of FIG. 4.

The clock signal CLXIN is also delayed by the same delay ΔT1 by the variable delay element 104*b*, like the start signal DXIN. The delayed clock signal is input in parallel to the level shifter 105*b* and the level shifter 106 to go through separate level shifts. The output signal from the level shifter 105*b* is input as an inverted clock signal CLXN to the data line driving circuit 20, while the output signal from the level shifter 106 is input as the clock signal CLX to the data line driving circuit 20. As shown in the timing chart of FIG. 4, the clock signal CLX and the inverted clock signal. CLXN have mutually inverted levels and respectively rise to the high level and fall to the low level at the timing T3.

The data line driving circuit 20 receives the inputs of the start signal DX, the clock signal CLX, and the inverted clock signal CLXN and generates output signals Q1 to Qn, which are given to the 3-input AND circuits L1 to Ln.

High-level time periods (pulse widths) of the output signals Q1 to Qn are identical with a high-level time period (pulse width) of the start signal DX. As shown in the timing chart of FIG. 4, the output signal Q1 rises to the high level at the timing T3, when the start signal DX rises to the high level. The output signal Q2 rises to the high level at a timing T10, which is delayed by a half cycle of the clock signal CLX from the output signal Q1. The output signals Q3, Q4, . . . , Qn successively rise to the high level at timings T11, T12, . . . , which are sequentially delayed by a half cycle of the clock signal CLX. Only the output signals Q1, Q2, and Q3 are shown in the timing chart of FIG. 4.

The output signals Q1 to Qn are input into respective first input terminals of the multiple 3-input AND circuits L1 to Ln shown in FIG. 1. The enable signal ENBX output from the X timing auto adjustment circuit 110 is input into respective second input terminals of the 3-input AND circuits L1 to Ln. The output signals Q2 to Qn from adjoining output stages are input into respective third input terminals of the 3-input AND circuits L1 to Ln. The 3-input AND circuits L1 to Ln carry out AND operations of the respective 3 inputs and output the results of the AND operations as the sampling circuit driving signals S1 to Sn to the sampling circuits SH1 to SHn.

For example, the 3-input AND circuit L1 receives the inputs of the output signal Q1, the enable signal ENBX, and the output signal Q2 from the adjoining output stage and outputs the sampling circuit driving signal S1 to the sampling circuits SH1 to SH6. As shown in the timing chart of FIG. 4, the sampling circuit driving signal S1 is kept at the high level for a time period between timings T21 and T22, when all the output signal Q1, the enable signal ENBX, and the adjoining output signal Q2 are at the high level. Similarly the 3-input AND circuit L2 outputs the sampling circuit driving signal S2, which is kept at the high level for a time period between timings T23 and T24, to the sampling circuits SH7 to SH12, as shown in the timing chart of FIG. 4.

The sampling circuit driving signals S1 to Sn output from the 3-input AND circuits L1 to Ln are input into respective gate electrodes of the sampling circuits SH1 to SHn. The video signals VID1 to VID6, which are input from the image processing module 600 shown in FIG. 3 to the sampling circuits SH1 to SHn and are expanded in parallel to 6 phases, are sampled and are output to the respective data lines X1 to Xn during the high-level time periods of the sampling circuit driving signals S1 to Sn.

For example, during the time period between the timings T21 and T22 when the sampling circuit driving signal S1 is kept at the high level as shown in the timing chart of FIG. 4, the TFTs of the sampling circuits SH1 to SH6 are respectively turned ON. The video signals VID1 to VID6 input into the sampling circuits SH1 to SH6 are then output to the data lines X1 to X6 connecting with the sampling circuits SH1 to SH6.

In the meanwhile, the scanning line driving circuit 30 sequentially scans the scanning lines Y1, Y2, . . . , Ym in this order and outputs a scanning line driving signal to each selected scanning line. For example, in the time period of the timings T21 and T22 shown in FIG. 4, it is assumed that the scanning line driving circuit 30 selects the scanning line Y1 and outputs the scanning line driving signal to the selected scanning line Y1. The TFTs of the pixel TFT circuits ST1 to STn connecting with the selected scanning line Y1 are respectively turned ON. As described above, in this time period, the video signals VID1 to VID6 are output from the sampling circuits SH1 to SH6 to the data lines X1 to X6. In response to the ON actions of the TFTs of the pixel TFT circuits ST1 to STn connecting with the selected scanning line Y1, the video signals VID1 to VID6 are input from the data lines X1 to X6 to only the six pixel electrodes 40 connecting with the pixel TFT circuits ST1 to ST6, among all the connecting pixel TFT circuits ST1 to STn.

This leads to variations in voltage between the six pixel electrodes 40 with inputs of the video signals VID1 to VID6 and a common electrode (not shown) and changes the configuration of the liquid crystal molecules in liquid crystal cells sealed between the pixel electrodes and the common electrode. The light entering the liquid crystal cells is permitted to transmit or is blocked off in response to the video signals VID1 to VID6, and is modulated to display a resulting image corresponding to the video signals VID1 to VID6 on the liquid crystal panel module 10.

As shown in the timing chart of FIG. 4, in this adequate state, the high-level time period of the sampling circuit driving signal S1 is temporally consistent with a later time period, that is, a saturation time period of light gray, in a signal cycle of the video signals VID1 to VID6 corresponding to the pixel TFT circuits ST1 to ST6. The pixel electrodes 40 connecting with the pixel TFT circuits ST1 to ST6 accordingly receive the inputs of the video signals VID1 to VID6 that have reached the saturation level of light gray. Similarly the pixel electrodes 40 connecting with other pixel TFT circuits ST7 to STn receive the inputs of the video signals VID1 to VID6 that have reached the saturation level of black. A resulting displayed image thus has substantially no ghost in this adequate state.

The dummy element 50 included in the liquid crystal panel module 10 receives the start signal DX from the X timing auto adjustment circuit 110, delays the input start signal DX, and outputs the delayed start signal as the monitor signal MONITOR to the X timing auto adjustment circuit 110.

As described above, the dummy element 50 is formed, together with the data line driving circuit 20 and the 3-input AND circuits L1 to Ln of the liquid crystal panel module 10, on an identical glass substrate. The dummy element 50 accordingly has similar retardance to those of the data line driving circuit 20 and the 3-input AND circuits L1 to Ln. A delay ΔT0 in the dummy element 50 is thus practically equivalent to signal delays in the data line driving circuit 20 and the 3-input AND circuits L1 to Ln.

The monitor signal MONITOR output from the dummy element 50 is generated by delaying the start signal DX by the delay ΔT0. In view of only the signal delays in the liquid crystal panel module 10, the monitor signal MONITOR is substantially equivalent to the sampling circuit driving signals S1 to Sn generated via the data line driving circuit 20 and the 3-input AND circuits L1 to Ln.

The start signal DX has the delay ΔT1 from the start signal DXIN given by the variable delay element 104*a*. The monitor signal MONITOR is accordingly delayed by a delay (ΔT1+ΔT0) from the start signal DXIN.

The monitor signal MONITOR output from the dummy element 50 to the X timing auto adjustment circuit 110 goes through a level shift by the level shifter 105*m* and is input into the phase comparator 101, which compares the phase of the level-shifted monitor signal with the phase of the reference signal REF.

The reference signal REF has a delay ΔT from the start signal DXIN given by the stationary delay element 103 in response to the clock signal CLK.

In the structure of this embodiment, the delay ΔT set in the stationary delay element 103 is equal to the delay (ΔT1+ΔT0) of the monitor signal MONITOR in the adequate state of FIG. 4. The stationary delay element 103 has a shift register, which changes over the number of shifts to keep the adequate state corresponding to the frequency of the clock signal CLK and the setting of the delay in the dummy element 50.

The phase of the monitor signal MONITOR is accordingly identical with the phase of the reference signal REF. Namely there is no phase difference between the monitor signal MONITOR and the reference signal REF. The phase comparator 101 detects no phase difference and thus does not output either of the charge-up pulse CU and the charge-down pulse CD to the charge pump 102.

The charge pump 102 does not receive either of the charge-up pulse CU and the charge-down pulse CD from the phase comparator 101 and accordingly does not vary the level of the control voltage VC, which is supplied to the variable delay elements 104*a* to 104*c*. In the adequate state, as shown in the timing chart of FIG. 4, the level of the control voltage VC is practically constant. The delays added by the variable delay elements 104*a* to 104*c* are thus not varied but are substantially fixed to ΔT1.

As described above, the variable delay elements 104*a* to 104*c* respectively add the delays to the timing signals, that is, the start signal DXIN, the clock signal CLXIN, and the enable signal ENBXIN. The delays added are practically fixed to ΔT1 in the adequate state. The respective timing signals input into the liquid crystal panel module 10, that is, the start signal DX, the clock signal CLX, the inverted clock signal CLXN, and the enable signal ENBX, accordingly rise to the high level at fixed adequate timings. The sampling circuit driving signals S1 to Sn generated from these timing signals thus rise to the high level at fixed adequate timings. The sampling circuits SH1 to SH6 sample the video signals VID1 to VID6 at fixed saturation timings and output the sampled video signals to the data lines X1 to Xn. This arrangement effectively prevents the appearance of ghost in a resulting image displayed on the liquid crystal panel module 10.

In the adequate state described above, the high-level time periods of the sampling circuit driving signals S1 to Sn are consistent with the saturation time periods of the video signals VID1 to VID6, as shown in the timing chart of FIG. 4.

When there is a variation in signal delay in the data line driving circuit 20 and the 3-input AND circuits L1 to Ln with a temperature change or with time in use, the output signals Q1 to Qn from the data line driving circuit 20 and the sampling circuit driving signals S1 to Sn from the 3-input AND circuits L1 to Ln are temporally shifted corresponding to the variation in signal delay from those in the adequate state. The video signals VID1 to VID6, on the other hand, do not pass through the data line driving circuit 20 or the 3-input AND circuits L1 to Ln and are thus input into the sampling circuits SH1 to SHn at the timing in the adequate state, even in the presence of a variation in signal delay in the data line driving circuit 20 and the 3-input AND circuits L1 to Ln. When there is a variation in signal delay in the data line driving circuit 20 and the 3-input AND circuits L1 to Ln with a temperature change or with time in use, the high-level time periods of the sampling circuit driving signal S1 to Sn are thus temporally deviated from the saturation time periods of the video signals VID1 to VID6.

The description now regards the specific operations in the case of a temporal deviation of the high-level time periods of the sampling circuit driving signals S1 to Sn from the saturation time periods of the video signals VID1 to VID6.

A3. Specific Operations in Advance State

Figure 5:
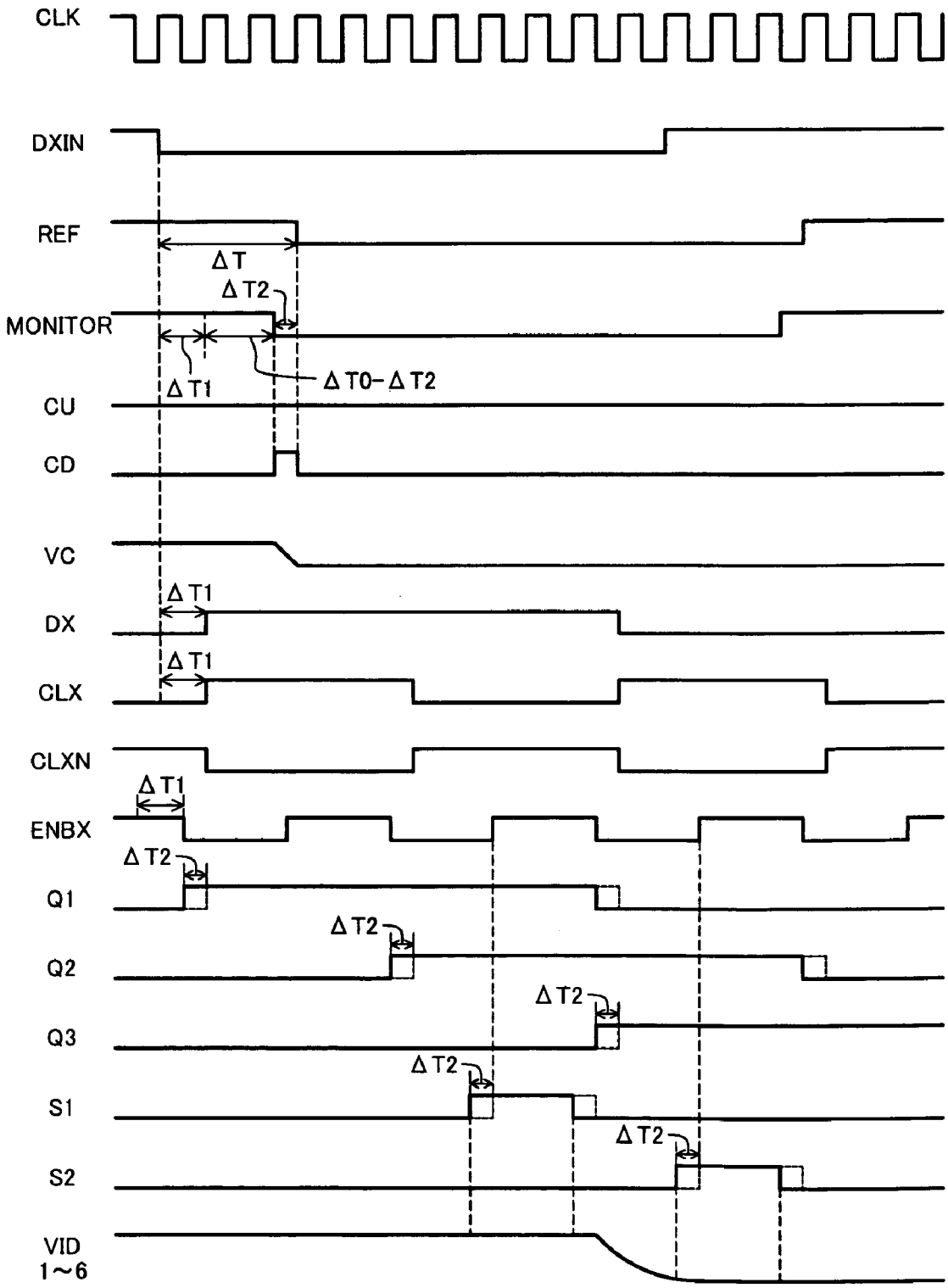
FIG. 5 is a timing chart showing the timings of the respective signals in an advance state in the embodiment.
Figure 6:
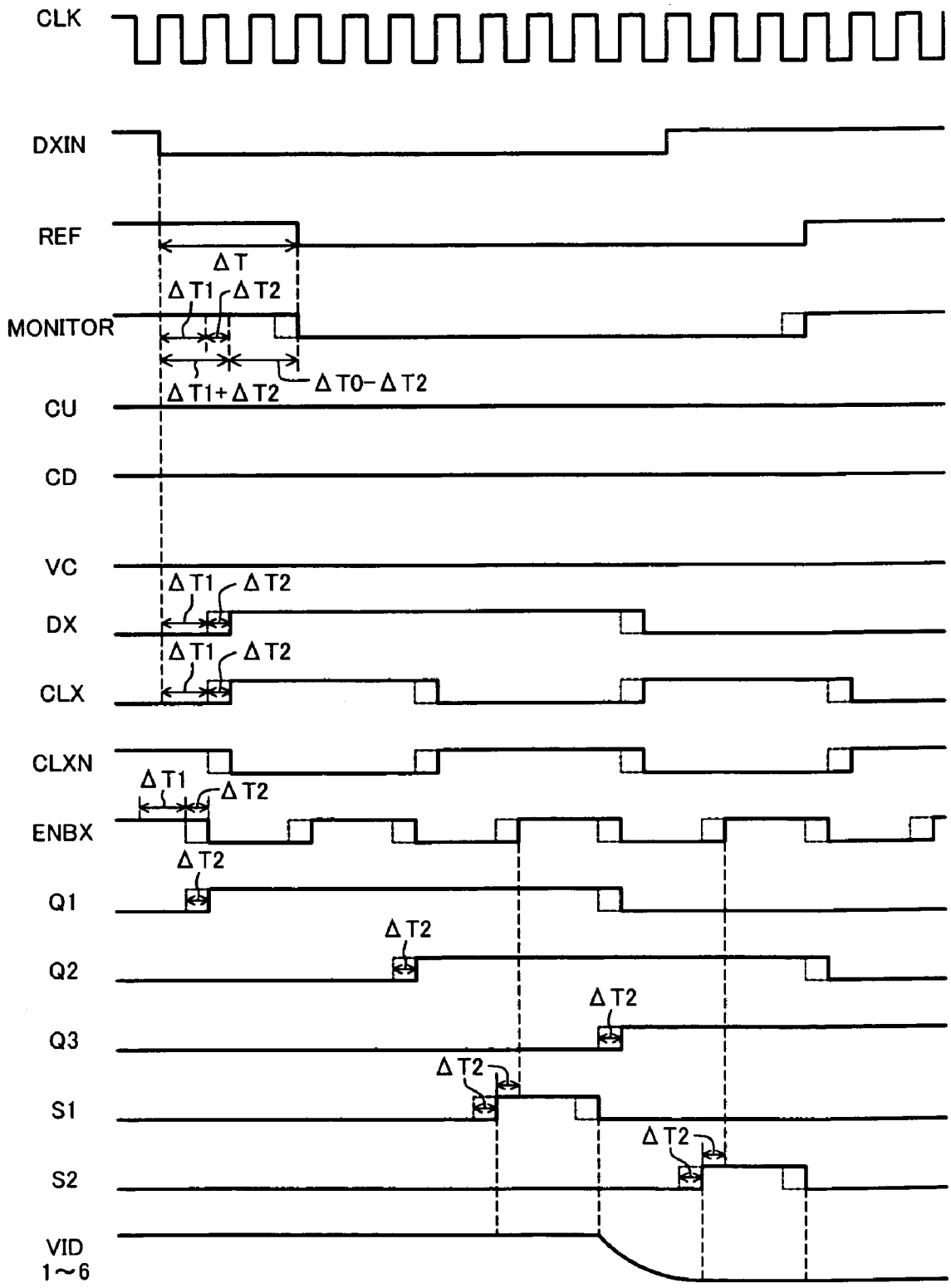
FIG. 6 is a timing chart showing the timings of the respective signals in the case of resumption of the adequate state from the advance state of FIG. 5 in the embodiment.

The description below relates to the specific operations in the case of a temporal advanced deviation of the high-level time periods of the sampling circuit driving signals S1 to Sn from the saturation time periods of the video signals VID1 to VID6 as shown in FIG. 2(B) to cause the appearance of ghost (hereafter referred to as the advance state). FIG. 5 is a timing chart showing the timings of the respective signals in the advance state. FIG. 6 is a timing chart showing a temporal correction of the embodiment to resume the adequate state from the advance state of FIG. 5.

The detailed operations of the timing generator 120, the data line driving circuit 20, the scanning line driving circuit 30, the 3-input AND circuits L1 to Ln, the sampling circuits SH1 to SHn, the pixel TFT circuits ST1 to STN, and the pixel electrodes 40 in the advance state are identical with those in the adequate state discussed above, and are thus not specifically described here.

In the advance state, as shown by the solid lines of the respective signals in the timing chart of FIG. 5, the high-level time period of the sampling circuit driving signal S1 is advanced by ΔT2 from the saturation time period when the video signals VID1 to VID6 corresponding to the pixel TFT circuits ST1 to ST6 have reached the saturation level of light gray. The video signals VID1 to VID6 are thus sampled at an advanced timing of ΔT2 from the saturation timing of light gray and are input into the pixel electrodes 40 connecting with the pixel TFT circuits ST1 to ST6. Similarly the video signals VID1 to VID6 are sampled at an advanced timing of ΔT2 from the saturation timing of black and are input into the pixel electrodes 40 connecting with the pixel TFT circuits ST7 to STn. For example, when the video signals VID1 to VID6 represent a ghost test pattern of FIG. 2, a displayed image has the appearance of ghost as shown in FIG. 2(B). The dotted lines of the respective signals in the timing chart of FIG. 5 represent the timings of the respective signals in the adequate state.

As described above, a variation in signal delay in the data line driving circuit 20 and the 3-input AND circuits L1 to Ln generally leads to a similar variation in signal delay in the dummy element 50. The monitor signal MONITOR output from the dummy element 50 is thus advanced by ΔT2 from the monitor signal MONITOR in the adequate state.

The phase of the monitor signal MONITOR is advanced by ΔT2 from the phase of the reference signal REF, so that the phase comparator 101 outputs the charge-down pulse CD to the charge pump 102 as the result of the phase comparison. The charge pump 102 receives the charge-down pulse CD and lowers the level of the control voltage VC supplied to the variable delay elements 104*a* to 104*c*.

The variable delay elements 104*a* to 104*c* receive the supplied control voltage VC of the lowered level and increase the setting of the delay to be added to the respective timing signals. More specifically the variable delay elements 104*a* to 104*c* add a delay (ΔT1+ΔT2), which is the sum of the delay ΔT1 added in the adequate state and the advance ΔT2, to the respective input timing signals, that is, the start signal DXIN, the clock signal CLXIN, and the enable signal ENBXIN. This operation delays the timing signals output from the X timing auto adjustment circuit 110, that is, the start signal DX, the clock signal CLX, the inverted clock signal CLXN, and the enable signal ENBX, by ΔT2 from those in the advance state, as shown by the solid lines in the timing chart of FIG. 6.

The output signals Q1 to Qn generated in response to the start signals DX, the clock signal CLX, and the inverted clock signal CLXN are also delayed by ΔT2 from those in the advance state, as shown by the solid lines in the timing chart of FIG. 6.

When the high-level time periods of the sampling circuit driving signals S1 to Sn are advanced by ΔT2 from those in the adequate state with a variation in signal delay in the data line driving circuit 20 and the 3-input AND circuits L1 to Ln, the technique of the embodiment adjusts the setting of the delay to be added to the respective input timing signals, that is, the start signal DXIN, the clock signal CLXIN, and the enable signal ENBXIN. This delays the output timing signals, that is, the start signal DX, the clock signal CLX, the inverted clock signal CLXN, and the enable signal ENBX, by ΔT2 from those in the advance state. The sampling circuit driving signals S1 to Sn generated in response to these output timing signals accordingly rise to the high level at the delayed timings of ΔT2 from those in the advance state, that is, at the adequate timings. This arrangement effectively cancels out the advance ΔT2.

As shown in the timing chart of FIG. 6, such cancel-out resumes the adequate state, where the high-level time periods of the sampling circuit driving signals S1 to Sn are temporally consistent with the saturation time periods of the video signals VID1 to VID6. The sampling circuits SH1 to SHn sample the video signals VID1 to VID6 at the saturation timings and output the sampled video signals to the data lines X1 to Xn. A resulting image displayed on the liquid crystal panel module 10 is accordingly free from the occurrence of ghost.

In the advance state, the delay set in the dummy element 50 is smaller by ΔT2, like the variation in signal delay in the data line driving circuit 20 and the 3-input AND circuits L1 to Ln. The delay set in the dummy element 50 in the advance state is thus equal to a difference (ΔT0−ΔT2) obtained by subtracting ΔT2 from the delay ΔT0 set in the dummy element 50 in the adequate state. The variable delay elements 104*a* to 104*c* supplement the decrement ΔT2 of the delay set in the dummy element 50 and add the resulting delay (ΔT1+ΔT2) to the respective timing signals, as described above.

In the resumed adequate state, the monitor signal MONITOR is delayed by (ΔT1+ΔT0), which is the sum of the delay (ΔT1+ΔT2) added by the variable delay element 104*a* and the delay (ΔT0−ΔT2) set in the dummy element 50, from the input start signal DXIN.

The reference signal REF is generated by delaying the start signal DXIN by ΔT, which is set to be equal to (ΔT1+ΔT0) by the stationary delay element 103. This makes the phase of the monitor signal MONITOR identical with the phase of the reference signal REF as shown in FIG. 6.

Because of the equality of the phase of the monitor signal MONITOR to the phase of the reference signal REF, the phase comparator 101 does not give either of the charge-up pulse CU and the charge-down pulse CD to the charge pump 102. There is accordingly no variation in control voltage VC. This keeps the fixed setting of the delay to be added by the variable delay elements 104*a* to 104*cm* and thereby continuously restrains the occurrence of ghost.

A4. Specific Operations in Lag State

Figure 7:
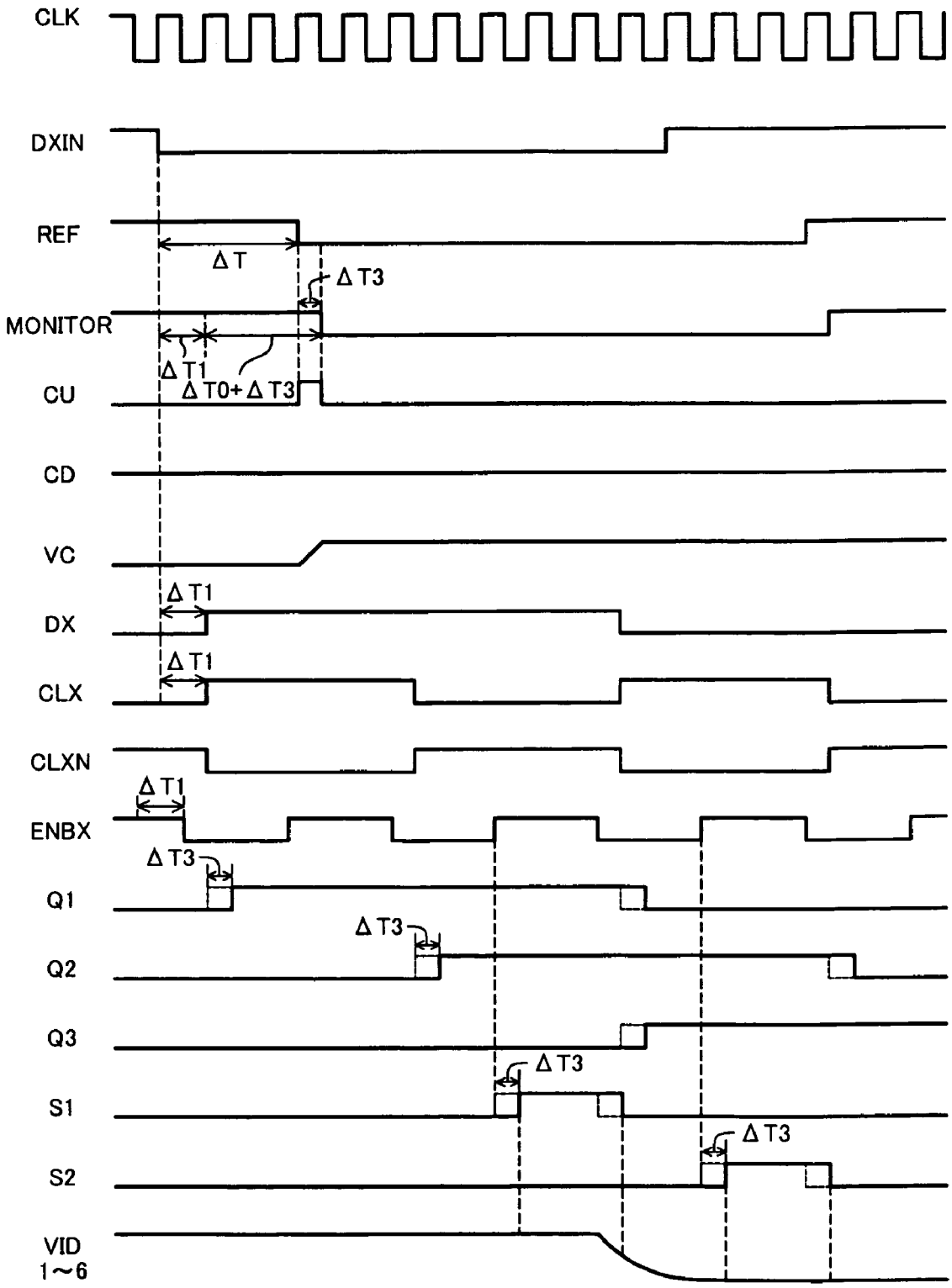
FIG. 7 is a timing chart showing the timings of the respective signals in a lag state in the embodiment.
Figure 8:
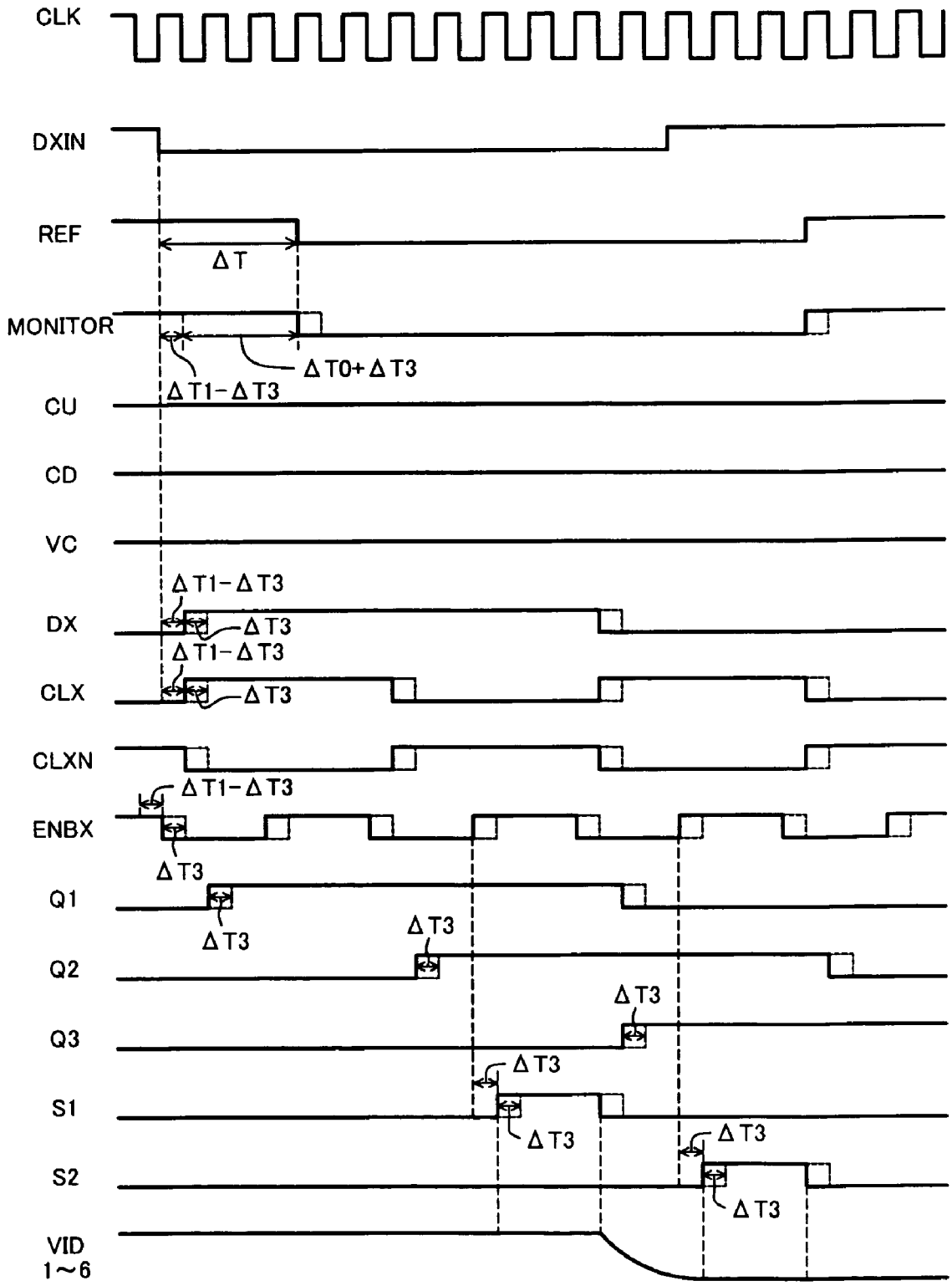
FIG. 8 is a timing chart showing the timings of the respective signals in the case of resumption of the adequate state from the lag state of FIG. 7 in the embodiment.

The description below relates to the specific operations in the case of a temporal delayed deviation of the high-level time periods of the sampling circuit driving signals S1 to Sn from the saturation time periods of the video signals VID1 to VID6 as shown in FIG. 2(C) to cause the appearance of ghost (hereafter referred to as the lag state). FIG. 7 is a timing chart showing the timings of the respective signals in the lag state. FIG. 8 is a timing chart showing a temporal correction of the embodiment to resume the adequate state from the lag state of FIG. 7.

The detailed operations of the timing generator 120, the data line driving circuit 20, the scanning line driving circuit 30, the 3-input AND circuits L1 to Ln, the sampling circuits SH1 to SHn, the pixel TFT circuits ST1 to STN, and the pixel electrodes 40 in the advance state are identical with those in the adequate state discussed above, and are thus not specifically described here.

In the lag state, as shown by the solid lines of the respective signals in the timing chart of FIG. 7, the high-level time period of the sampling circuit driving signal S1 is delayed by ΔT3 from the saturation time period when the video signals VID1 to VID6 corresponding to the pixel TFT circuits ST1 to ST6 have reached the saturation level of light gray. The video signals VID1 to VID6 are thus sampled at a delayed timing of ΔT3 from the saturation timing of light gray and are input into the pixel electrodes 40 connecting with the pixel TFT circuits ST1 to ST6. Similarly the video signals VID1 to VID6 are sampled at a delayed timing of ΔT3 from the saturation timing of black and are input into the pixel electrodes 40 connecting with the pixel TFT circuits ST7 to STn. For example, when the video signals VID1 to VID6 represent a ghost test pattern of FIG. 2, a displayed image has the appearance of ghost as shown in FIG. 2(C). The dotted lines of the respective signals in the timing chart of FIG. 7 represent the timings of the respective signals in the adequate state.

The dummy element 50 is formed with the circuit elements in the liquid crystal panel module 10 on an identical substrate and thus has substantially equivalent retardance to those of the circuit elements in the liquid crystal panel module 10. A variation in signal delay accordingly arises in the dummy element 50, as in the other circuit elements of the liquid crystal panel module 10. The monitor signal MONITOR output from the dummy element 50 is thus delayed by ΔT3 from the monitor signal MONITOR in the adequate state.

The phase of the monitor signal MONITOR is delayed by ΔT3 from the phase of the reference signal REF, so that the phase comparator 101 outputs the charge-up pulse CU to the charge pump 102 as the result of the phase comparison. The charge pump 102 receives the charge-up pulse CU and raises the level of the control voltage VC supplied to the variable delay elements 104*a* to 104*c*.

The variable delay elements 104*a* to 104*c* receive the supplied control voltage VC of the raised level and decrease the setting of the delay to be added to the respective timing signals. More specifically the variable delay elements 104*a* to 104*c* add a delay (ΔT1−ΔT3), which is the difference by subtracting the lag ΔT3 from the delay ΔT1 added in the adequate state, to the respective input timing signals, that is, the start signal DXIN, the clock signal CLXIN, and the enable signal ENBXIN. This operation advances the timing signals output from the X timing auto adjustment circuit 110, that is, the start signal DX, the clock signal CLX, the inverted clock signal CLXN, and the enable signal ENBX, by ΔT3 from those in the lag state, as shown by the solid lines in the timing chart of FIG. 8.

The output signals Q1 to Qn generated in response to the start signals DX, the clock signal CLX, and the inverted clock signal CLXN are also advanced by ΔT3 from those in the lag state, as shown by the solid lines in the timing chart of FIG. 8.

When the high-level time periods of the sampling circuit driving signals S1 to Sn are delayed by ΔT3 from those in the adequate state with a variation in signal delay in the liquid crystal panel module 10, the technique of the embodiment adjusts the setting of the delay to be added to the respective input timing signals, that is, the start signal DXIN, the clock signal CLXIN, and the enable signal ENBXIN. This advances the output timing signals, that is, the start signal DX, the clock signal CLX, the inverted clock signal CLXN, and the enable signal ENBX, by ΔT3 from those in the lag state. The sampling circuit driving signals S1 to Sn generated in response to these output timing signals accordingly rise to the high level at the advanced timings of ΔT3 from those in the lag state, that is, at the adequate timings. This arrangement effectively cancels out the lag ΔT3.

As shown in the timing chart of FIG. 8, such cancel-out resumes the adequate state, where the high-level time periods of the sampling circuit driving signals S1 to Sn are temporally consistent with the saturation time periods of the video signals VID1 to VID6. The sampling circuits SH1 to SHn sample the video signals VID1 to VID6 at the saturation timings and output the sampled video signals to the data lines X1 to Xn. A resulting image displayed on the liquid crystal panel module 10 is accordingly free from the occurrence of ghost.

In the lag state, the delay set in the dummy element 50 is greater by ΔT3, like the variation in signal delay in the liquid crystal panel module 10. The delay set in the dummy element 50 in the lag state is thus equal to a sum (ΔT0+ΔT3) obtained by adding ΔT3 to the delay ΔT0 set in the dummy element 50 in the adequate state. The variable delay elements 104*a* to 104*c* decrease the increment ΔT3 of the delay set in the dummy element 50 and add the resulting delay (ΔT1−ΔT3) to the respective timing signals, as described above.

The reference signal REF is generated by delaying the start signal DXIN by ΔT, which is set to be equal to (ΔT1+ΔT0) by the stationary delay element 103. This makes the phase of the monitor signal MONITOR identical with the phase of the reference signal REF as shown in FIG. 8.

Because of the equality of the phase of the monitor signal MONITOR to the phase of the reference signal REF, the phase comparator 101 does not give either of the charge-up pulse CU and the charge-down pulse CD to the charge pump 102. There is accordingly no variation in control voltage VC. This keeps the fixed setting of the delay to be added by the variable delay elements 104*a* to 104*cm* and thereby continuously restrains the occurrence of ghost.

As described above, the technique of the embodiment compares the phase of the reference signal REF with the phase of the monitor signal MONITOR and thereby detects a temporal deviation of the high-level time periods of the sampling circuit driving signals S1 to Sn from the saturation time periods of the video signals VID1 to VID6, which is caused by a variation in signal delay in the liquid crystal panel module 10 with a temperature change or with time in use.

The X timing auto adjustment circuit 110 uses the charge pump 102 to adjust the setting of the delay, which is to be added by the variable delay elements 104*a* to 104*c* to the respective input timing signals, that is, the start signal DXIN, the clock signal CLXIN, and the enable signal ENBXIN and thereby cancel out the detected temporal deviation. The adjustment increases the setting of the delay in response to a temporal advanced deviation, while decreasing the setting of the delay in response to a temporal delayed deviation.

This adjusts the output timing signals, that is, the start signal DX, the clock signal CLX, the inverted clock signal CLXN, and the enable signal ENBX. Such adjustment cancels out the temporal deviation of the sampling circuit driving signals S1 to Sn, which is caused by the variation in signal delay in the liquid crystal panel module 10. The high-level time periods of the sampling circuit driving signals S1 to Sn, which are generated in response to the output timing signals, are thus temporally consistent with the saturation time periods of the video signals VID1 to VID6. This arrangement effectively restrains the occurrence of ghost.

A5. Another Example of X Timing Auto Adjustment Circuit

The X timing auto adjustment circuit 110 shown in FIG. 1 includes the phase comparator 101, the charge pump 102, and the variable delay elements 104*a* to 104*c*. This structure may be replaced by the structure of FIG. 9 that includes a phase comparator 501, a low-pass filter 502, a voltage controlled oscillator 503, and variable delay elements 514*a* to 514*c* of shift registers.

Figure 9:
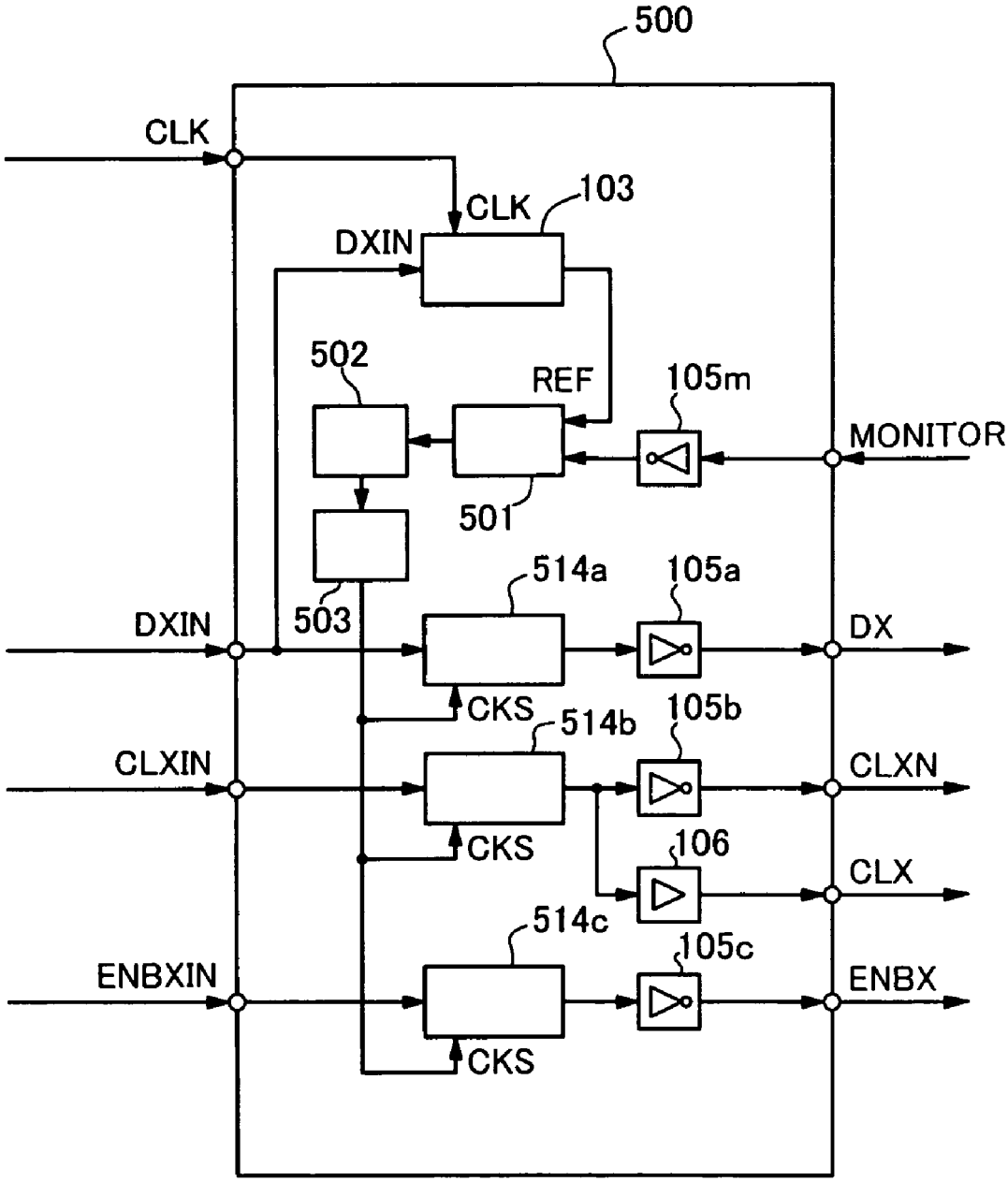
FIG. 9 schematically illustrates an X timing auto adjustment circuit 500 of one modified structure.

FIG. 9 shows an X timing auto adjustment circuit 500 of another structure as a modified example of the embodiment. The X timing auto adjustment circuit 500 shown in FIG. 9 has the phase comparator 501, the low-pass filter 502, the voltage controlled oscillator 503, and the variable delay elements 514*a* to 514*c* of the shift registers, in addition to the stationary delay element 103 and the level shifters 105*a* to 105*c*, 105*m*, and 106, which are identical with those included in the X timing auto adjustment circuit 110 of the embodiment shown in FIG. 1.

The phase comparator 501 receives the inputs of the monitor signal MONITOR from the level shifter 105*m* and the reference signal REF, compares the phases of these two input signals, and outputs a pulse signal corresponding to the phase difference. The low-pass filter 502 extracts a low-pass component of the pulse signal output from the phase comparator 501 and outputs the extracted low-pass component as a voltage. The voltage controlled oscillator 503 oscillates to output a clock signal, while receiving the output voltage from the low-pass filter 502 as a control voltage. The voltage controlled oscillator 503 varies the oscillation frequency and the frequency of the clock signal corresponding to the input control voltage. The variable delay elements 514*a* to 514*c* input the respective timing signals from the timing generator 120, that is, the start signal DXIN, the clock signal CLXIN, and the enable signal ENBXIN, delay the input timing signals, and output the delayed timing signals to the level shifters 105*a* to 105*c* and 106. The variable delay elements 514*a* to 514*c* also input the clock signal from the voltage controlled oscillator 503 and vary the setting of the delay in response to the frequency of the input clock signal.

The X timing auto adjustment circuit 500 shown in FIG. 9 has the equivalent functions to those of the X timing auto adjustment circuit 110 shown in FIG. 1 to adjust the phases of the timing signals generated by the timing generator 120 and supply the phase-adjusted timing signals to the liquid crystal panel module 10.

B. Modifications

The embodiment and its modified examples discussed above are to be considered in all aspects as illustrative and not restrictive. There may be many modifications, changes, and alterations without departing from the scope or spirit of the main characteristics of the present invention. Some examples of possible modification are given below.

(1) The technique of the embodiment corrects a temporal deviation of the sampling circuit driving signals S1 to Sn from the video signals VID1 to VID6 to restrain the occurrence of ghost. One modified procedure may alternatively correct a temporal deviation of the scanning signals output from the scanning line driving circuit 30 from the video signals VID1 to VID6 to restrain the occurrence of ghost in the direction 'y' of FIG. 1.

In this modified structure, the liquid crystal panel module 10 has a dummy element equivalent to the dummy element 50, whereas the timing supply module 100 includes a Y timing auto adjustment circuit having a similar construction to that of the X timing auto adjustment circuit 110 or 500. A phase-adjusted timing signal is output from the Y timing auto adjustment circuit to the scanning line driving circuit 30, instead of the clock signal CK generated by the timing generator 120.

(2) The structure of the embodiment discussed above expands the input video signals in parallel to 6 phases. The number of the expanded phases is not restrictive, and the technique of the invention is applicable to, for example, input video signals expanded in parallel to 12 phases. The structure requires a number of video signal lines corresponding to the number of the expanded phases.

(3) In the structure of the embodiment discussed above, the start signal DX is input into the dummy element 50. This is, however, not essential, and another timing signal, for example, the clock signal CLX, the inverted clock signal CLXN, or the enable signal ENBX, may be input into the dummy element 50. A divided or multiplied signal of any of the start signal DX, the clock signal CLK, the inverted clock signal CLXN, and the enable signal ENBX may alternatively be input into the dummy element 50. A composite signal of any of the start signal DX, the clock signal CLK, the inverted clock signal CLXN, and the enable signal ENBX may otherwise be input into the dummy element 50. The signal input into the dummy element 50 as the basis of the monitor signal MONITOR may be any signal having a specific phase relation to the reference signal REF.

(4) The technique of the embodiment adjusts the phases of the respective timing signals, that is, the start signal DXIN, the clock signal CLXIN, and the enable signal ENBXIN. Such adjustment enables the sampling circuits SH1 to SHn to sample the video signals VID1 to VID6 at the saturation timings. One modified procedure may adjust the phases of the video signals VID1 to VID6, instead of the phases of the timing signals.

Figure 10:
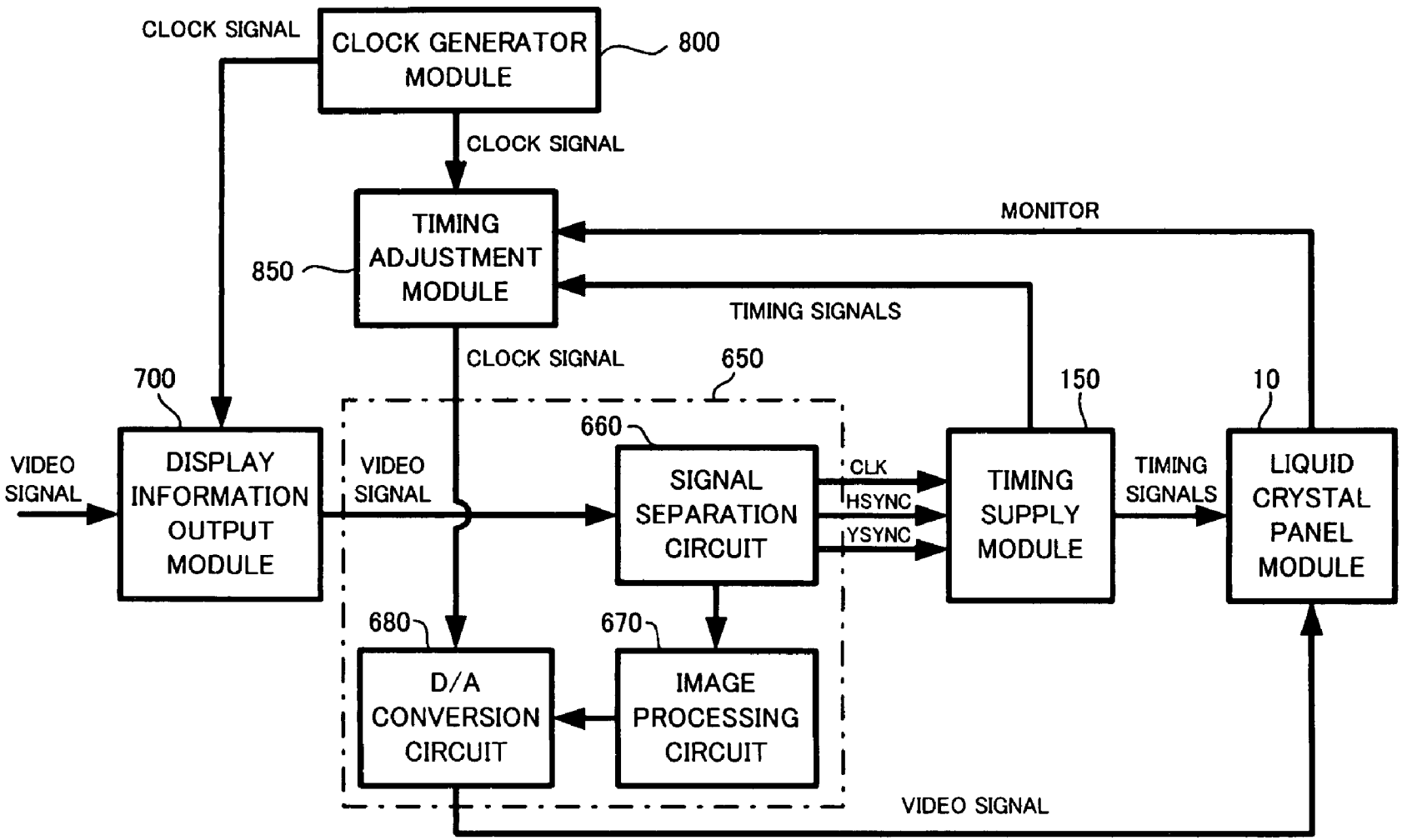
FIG. 10 schematically illustrates the structure of a liquid crystal display device in one modified example of the embodiment.

One example of such modification is shown in FIG. 10. FIG. 10 schematically illustrates the structure of a liquid crystal display device in the modified example. The liquid crystal display device of this modified example includes a liquid crystal panel module 10, a timing supply module 150, an image processing module 650, a display information output module 700, a clock generator module 800, and a timing adjustment module 850. The image processing module 650 has a signal separation circuit 660, an image processing circuit 670, and a D/A conversion circuit 680. A power supply module is omitted from the structure of FIG. 10. The operations of the display information output module 700 and the clock generator module 800 are identical with those discussed above with reference to FIG. 3 and are thus not specifically described here.

In the image processing module 650, the signal separation circuit 660 extracts a clock signal CLK, a horizontal synchronizing signal HSYNC, and a vertical synchronizing signal VSYNC from input video signals and outputs these extracted signals to the timing supply module 150. The image processing circuit 670 makes the video signals subjected to various series of image processing. The D/A conversion circuit 680 converts the processed digital video signals into analog signals, in response to a separately supplied clock signal, and outputs the analog signals to the liquid crystal panel module 10. The timing supply module 150 generates timing signals to determine the timings of driving the liquid crystal panel module 10, in response to the clock signal CLK, the horizontal synchronizing signal HSYNC, and the vertical synchronizing signal VSYNC input from the image processing module 650. The timing supply module outputs the generated timing signals to the liquid crystal panel module 10, while outputting part of the timing signals to the timing adjustment module 850. The liquid crystal panel module 10 is driven in response to the timing signals supplied from the timing supply module 100 to display the video signals VID1 to VID6 input from the image processing module 650 as a resulting image, while outputting a monitor signal MONITOR output from an internal dummy element to the timing adjustment module 850. The timing adjustment module 850 generates a reference signal from the timing signal input from the timing supply module 150, adjusts the phase of a clock signal supplied by the clock generator module 800 to make the monitor signal MONITOR input from the liquid crystal panel module 10 keep a specific phase relation to the reference signal, and supplies the phase-adjusted clock signal to the D/A conversion circuit 680.

The timing adjustment module 850 adjusts the phase of the clock signal to be supplied to the D/A conversion circuit 680, while the image processing module 650 converts the digital video signals into analog signals. Such phase adjustment advances or delays the phases of the video signals VID1 to VID6.

This arrangement does not require adjustment of the phases of the multiple timing signals and thus advantageously reduces the required circuit size.

All changes within the meaning and range of equivalency of the claims are intended to be embraced therein. The scope and spirit of the present invention are indicated by the appended claims, rather than by the foregoing description.

Finally, the present application claims the priority based on Japanese Patent Application No. 2003-342821 filed on Oct. 1, 2003, which is herein incorporated by reference.

What is claimed is:

1. A liquid crystal display device comprising:

a liquid crystal panel module; and a timing supply module that supplies a timing signal to the liquid crystal panel module, the liquid crystal panel module including:

multiple liquid crystal cells that are arranged in a matrix;

multiple pixel electrodes that are provided corresponding to the respective liquid crystal cells;

multiple data lines that input a video signal to the respective pixel electrodes;

multiple sampling circuits that are provided corresponding to the respective data lines to sample the video signal in response to a sampling circuit driving signal and output the sampled video signal to the respective data lines; and a driving signal generator that generates the sampling circuit driving signal in response to the timing signal, the timing supply module including:

a timing generator that generates the timing signal; and a timing adjuster that adjusts a phase of the generated timing signal, the liquid crystal panel module having a dummy element, which is formed at least with the driving signal generator on an identical substrate, the dummy element receiving the timing signal, delaying the input timing signal, and outputting the delayed timing signal, and the timing adjuster adjusting the phase of the generated timing signal, in order to enable the output signal from the dummy element to keep a specific phase relation to a separately provided reference signal.

2. The liquid crystal display device in accordance with claim 1, the timing adjuster including:

a phase comparator that compares a phase of the reference signal with a phase of the output signal from the dummy element and outputs a phase difference signal corresponding to a result of the comparison;

a charge pump that outputs a control voltage and regulates a level of the control voltage in response to the phase difference signal output from the phase comparator; and a delay element that varies a delay of the timing signal and thereby adjusts the phase of the timing signal according to the regulated level of the control voltage.

3. The liquid crystal display device in accordance with claim 1, the timing adjuster including:

a phase comparator that compares a phase of the reference signal with a phase of the output signal from the dummy element and outputs a phase difference signal corresponding to a result of the comparison;

an oscillator that outputs a clock signal and regulates a frequency of the clock signal in response to the phase difference signal output from the phase comparator; and a delay element that varies a delay of the timing signal and thereby adjusts the phase of the timing signal according to the regulated frequency of the clock signal.

4. A liquid crystal display device comprising:

a liquid crystal panel module;

a video signal supply module that supplies a video signal to the liquid crystal panel module;

a timing supply module that supplies a timing signal to the liquid crystal panel module; and a video signal control module that controls the video signal supply module, the liquid crystal panel module including:

multiple liquid crystal cells that are arranged in a matrix;

multiple pixel electrodes that are provided corresponding to the respective liquid crystal cells;

multiple data lines that input the video signal to the respective pixel electrodes;

multiple sampling circuits that are provided corresponding to the respective data lines to sample the video signal in response to a sampling circuit driving signal and output the sampled video signal to the respective data lines; and a driving signal generator that generates the sampling circuit driving signal in response to the timing signal, the liquid crystal panel module having a dummy element, which is formed at least with the driving signal generator on an identical substrate, the dummy element receiving the timing signal, delaying the input timing signal, and outputting the delayed timing signal, and the video signal control module controlling the video signal supply module to adjust a phase of the video signal, in order to enable the output signal from the dummy element to keep a specific phase relation to a separately provided reference signal.

5. The liquid crystal display device in accordance with claim 4, the video signal supply module including a D/A conversion circuit that converts a digital video signal into an analog video signal, in response to a separately supplied clock signal, the video signal control module including a timing adjuster that adjusts a phase of the clock signal supplied to the D/A conversion circuit, and the timing adjuster adjusting the phase of the clock signal, in order to enable the output signal from the dummy element to keep the specific phase relation to the reference signal.

6. A liquid crystal panel that receives at least inputs of a timing signal and a video signal, the liquid crystal panel comprising:

multiple liquid crystal cells that are arranged in a matrix;

multiple pixel electrodes that are provided corresponding to the respective liquid crystal cells;

multiple data lines that input the video signal to the respective pixel electrodes;

multiple sampling circuits that are provided corresponding to the respective data lines to sample the video signal in response to a sampling circuit driving signal and output the sampled video signal to the respective data lines;

a driving signal generator that generates the sampling circuit driving signal in response to the timing signal;

a dummy element that is formed at least with the driving signal generator on an identical substrate, receives the timing signal, delays the input timing signal, and outputs the delayed timing signal;

a terminal that inputs the timing signal to the dummy element; and a terminal that supplies the output signal from the dummy element to outside.

* * * * *